United States Patent [19]

Mourier

[11] 4,087,721

[45] May 2, 1978

[54] ION SOURCE USING A HOLLOW CATHODE DISCHARGE ARRANGEMENT AND IN PARTICULAR A PARTICLE ACCELERATOR COMPRISING SUCH A SOURCE

[75] Inventor: Georges Mourier, Paris, France

[73] Assignee: Thomson-CSF, Paris, France

[21] Appl. No.: 687,087

[22] Filed: May 13, 1976

[30] Foreign Application Priority Data

May 16, 1975 France ..... 75 15440

[51] Int. Cl.[2] ..... H01J 27/00

[52] U.S. Cl. ..... 313/230; 313/209

[58] Field of Search ..... 313/230, 209

*Primary Examiner*—Robert Segal

*Assistant Examiner*—Darwin R. Hostetter

*Attorney, Agent, or Firm*—Roland Plottel

[57] ABSTRACT

The ion source according to the invention comprises a hollow cathode discharge arrangement 10 in which a plasma is produced by the ionization of a gas under the effect of a positive d.c. voltage applied to an anode 3 in relation to two cathodes 1 and 20. One of these cathodes 20 is formed with holes 30 through which some of the ions of the plasma escape. A filament 7 emits slow electrons towards this cathode, neutralizing the space charge created ahead of this cathode by the ions having left the arrangement and enables them to be propagated towards a point of use 40 situated at a considerable distance. A grid 8 limits the number of these electrons entering the arrangement 10. The source provides ion beams of clearly defined energy and high density.

4 Claims, 3 Drawing Figures

ION SOURCE USING A HOLLOW CATHODE DISCHARGE ARRANGEMENT AND IN PARTICULAR A PARTICLE ACCELERATOR COMPRISING SUCH A SOURCE

This invention relates to an ion source.

Ion sources are required for numerous applications as diverse as heavy particle accelerators, isotope separation installations, thermonuclear reactors, surface treatment installations, certain chemical installations, etc.

In already known arragements, so-called hollow cathode arrangements, which will be discussed hereinafter, plasmas are generated with a high ion density.

However, it would appear that their use as an ion source involves the problem of extracting ions from these arrangements so as to produce a beam directed towards a point of use remote from the place where these ions are produced, i.e. the hollow-cathode arrangement in question.

The present invention relates to a system consisting of a hollow cathode discharge device and associated means for extracting from it a beam of ions so as to form a source of ions which may be used at the required point.

Another object of the invention is an ion accelerator, using such an ion source.

Figure 1:
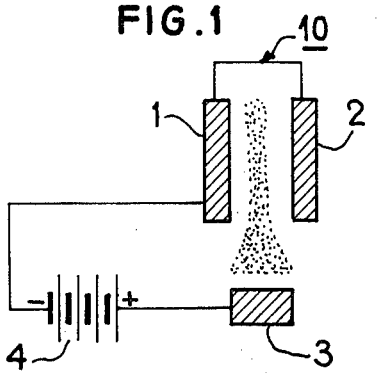

These hollow cathode arrangements as known in the prior art are recalled in the following description which then goes on to give one example of an ion source according to the invention using one of these arrangements. This description is given with reference to the accompanying drawings, wherein:

FIG. 1 diagrammatically illustrates a conventional hollow cathode arrangement.

Figure 2:
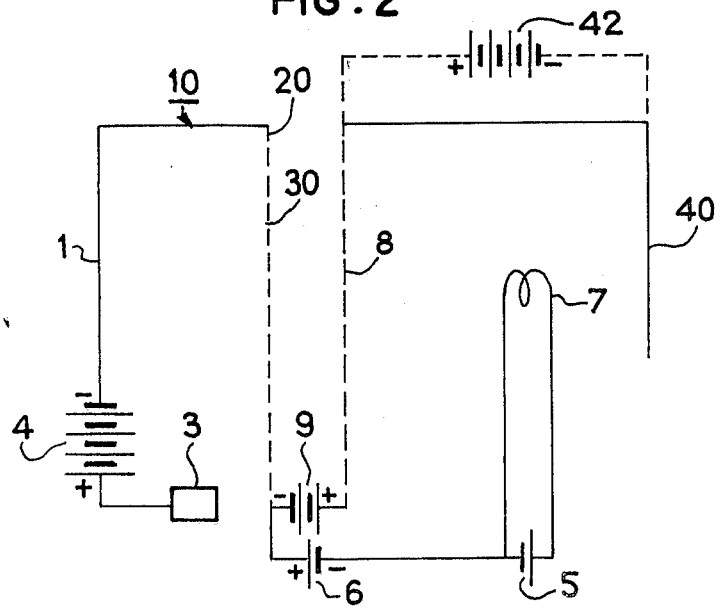
PRIOR ART FIG. 2

FIG. 2 diagrammatically illustrates an ion source using the arrangement illustrated in FIG. 1.

Figure 3:
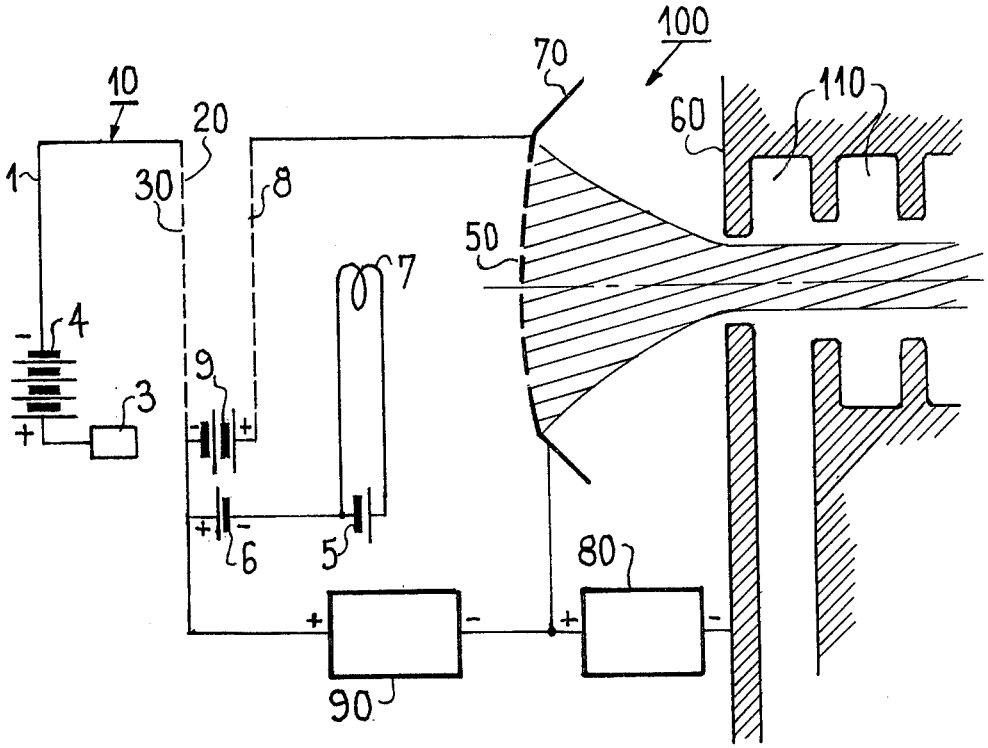

FIG. 3 diagrammatically illustrates an ion accelerator, incorporating an ion source — according to FIG. 2.

FIG. 1 diagrammatically illustrates a discharge arrangement 10 with a hollow cathode as known in the art, comprising two parallel conductive plates 1 and 2 acting as cold cathodes in relation to an anode 3 which, in operation, is brought to a positive d.c. control potential V relative to these cathodes by the voltage source 4. An inert ionisable gas, for example argon, circulates around the cathodes 1, 2 and the anode 3 under a low pressure, for example amounting to between 0.1 and 5 mm of mercury. When the anode is brought to the potential V, a discharge occurs and the gas is ionised. For a sufficiently narrow distance, of the order of a few millimetres, between the plates 1 and 2, a brilliant glow is observed between the cathodes, extending up to the anode 3. This glow comes from a sheet of plasma resulting from the discharge in question. This sheet, represented in the drawing by the dotted area, is separated from the cathodes 1 and 2 by what are normally referred to as sheaths with a thickness of the order of 1 millimetre.

Virtually the entire plasma is concentrated in the brilliant sheet in question. The anode, of which the potential is positive in relation to the cathodes, extracts some of the electrons from this sheet so that the sheet also assumes a positive potential in relation to these cathodes similar to that of the anode. In operation, the ions of this plasma are accelerated through the sheaths towards the cathodes with a clearly defined energy which is substantially that arising out of the potential V.

Tests have shown that, at pressures below 0.1 mm of mercury, it is the impact of the ions which extract the electrons from the cathodes to support the discharge. On the other hand, the ionic current in question has a high density which, in ordinary cases, may reach 20 milliamps per square centimeter. Finally, high current intensities may be obtained with plates 1 and 2 of large surface area.

More information on the hollow cathode arrangements discussed above may be found in the Article by Gordon Francis entitled "The Glow Discharge at low Pressure" in Handbuch der Physik, Vol. 22, pages 91 et.seq, Springer Verlag, 1956.

The invention utilises this stream of ions towards the cathodes of the hollow cathode discharge arrangements for forming an ion source with the properties referred to above under the conditions specified below with reference to FIG. 2.

FIG. 2 diagrammatically illustrates by way of example an examplary embodiment of the ion source according to the invention comprising, as before, the cathode 1 and the anode 3 and also the source 4. On the other hand, the second cathode, which in this Figure bears the reference 20, is formed with holes, such as 30, for allowing some of the ions of the plasma to pass through towards the outside of the arrangement 10. These ions leave the plasma with the energy with which they normally collide with the solid cathodes of the hollow cathode arrangements described above with reference to FIG. 1. This energy has reached a few hundred electron volts, i.e. from 800 to 1500 eV, in some of the Applicant's experimental arrangements. In some cases, it is sufficient for the application envisaged for the ion beam which is propagated at its initial velocity into the substantially equipotential space situated ahead of the point of use 40. In other cases where greater energy is required at the point of use, these ions are accelerated by a source towards the point 40.

However, the ions having thus passed through the cathode 20 form beyond the cathode a space charge which is highly positive, all the more so because, as already mentioned, the ion density of the plasmas produced in these arrangements is high. In order to prevent them from turning back towards the cathode 20 under the influence of this space charge, which they would otherwise do after a distance of the order of the thickness of the sheaths, i.e. the distance separating the plasma from the cathodes, a filament 7 heated by the source 5 and brought to a slightly negative d.c. potential in relation to the potential of the cathodes by the voltage source 6 is provided in accordance with the invention in the path of the ion beam beyond the cathode 20. The slow electrons emitted under these conditions by the filament neutralise the space charge in question and enable the ions to be propagated over a much greater distance to the point of use 40.

However, in order to prevent these electrons from entering the hollow cathode arrangement in excessive numbers through the holes 30, and from neutralising the plasma formed between the two cathodes, a grid 8 brought to a slightly positive d.c. potential in relation to the cathode 20 by the voltage source 9 is provided in accordance with the invention between the filament 7 and the cathode 20 in the proximity of the cathode. This grid captures some of the slow electrons emitted by the filament 7 and prevents them from entering the hollow cathode arrangement between the cathodes 1 and 20. That fraction of the electronic current emanating from the filament 7 which escapes the attraction of the grid and enters the arrangement 10 through the holes 30 performs a useful function in compensating the loss of emission due to the reduction in the surface area of the plate 20 caused by the presence of the holes 30. The quantity of electrons entering the arrangement 10 may be controlled inter alia by the temperature of the filament 7.

In the arrangements according to the invention, the extraction of ions has to be limited to a certain proportion of the total quantity of ions present in the plasma if the discharge is to be able to continue to support itself. Perforated cathodes 20 are used for this purpose, the transparency of which or ratio of the surface area of the perforations to the total surface area of the cathode does not exced much more than 50%. Under these conditions, only 25% of the ions produced in the arrangement 10 are extracted, enabling the discharge to be supported whilst at the same time ensuring, apart from any post-acceleration, an energy efficiency of approximately 25%, measured as the ratio of the kinetic energy of the beam of ions extracted to the total electrical energy supplied to the arrangement 10. This value is high in relation to that of other known ion sources.

The mesh size of the grid 8 and of the perforated cathode 20 and the distance between these two components are of the same order of magnitude as the thickness of the sheaths which is normally 1 mm.

For a control voltage of 1500 volts, the potential of the grid 8 in relation to the cathode 20 and the potential of the filament 7 in relation to the same cathode were selected in one example as + 20 volts and −15 volts, respectively.

With flat cathodes consisting of two rectangular plates with a surface area of 50 $cm^2$, spaced 4 mm apart from one another, and under an argon pressure of 0.1 mm of mercury, propagating itself over a distance of 80 cm into the equipotential space separating the source 10 from the input of a 5 MeV ion accelerator. The means for concentrating the beam and the means for establishing the necessary pressure gradient between the preceding pressure of 0.1 mm of mercury and the much lower pressure prevailling in the accelerator were distributed over this distance.

Finally, FIG. 2 shows in solid lines the case where the ions supplied by the source are propagated into an equipotential space between the grid 8 and the point of use 40, and in chain lines the case of a beam of ions accelerated towards this point by a voltage source 42 (upper part of the Figure).

FIG. 3 diagrammatically shows an ion accelerator using an ion source according to FIG. 2. In the example, at the point of use 40 of FIG. 2 there is located in ion accelerator 100, whose grid 50 is energized by the d.c. source 90; this grid communicates to the ion beam (not shown), emanating from the discharge arrangement 10, a first acceleration in the space extending from perforated cathode 20 to the grid 50. Reference 70 designates a Pierce electrode associated with grid 50. The ion beam, penetrates into the accelerator 100 through the grid 50 and propagates towards the electrode 60 and the resonators 110 of the accelerator. The beam (hatched surface) undergoes in this region a post-acceleration under the effect of the direct voltage supplied by the source 80. Vacuum means have not been shown in the diagrammatical view of FIG. 3.

Of course, the invention is not limited to the embodiment described and shown which was given solely by way of example.

What is claimed is:

1. An ion source, wherein a hollow cathode discharge arrangement is comprised, in a mass of ionisable gas, of two cathodes arranged opposite one another and an anode spaced apart from said cathodes and facing the space delimited by the same, and means for bringing this anode to a positive d.c. control potential V in relation to said cathodes under the effect of which the gas is ionised and a sheet of plasma formed, this sheet of plasma extending between the cathodes at a certain distance from each of them up to the anode; wherein one of said cathodes is formed with holes through which some of the ions of the plasma escape; wherein a hot filament brought to a negative d.c. potential in relation to said perforated cathode is placed in the path of these ions towards the point at which they are used, said filament emitting electrons towards said cathode, and wherein a grid brought to a positive d.c. potential relative to said perforated cathode is arranged between said filament and said perforated cathode, said grid being situated at a distance from said perforated cathode of the order of the distance separating said plasma from said perforated cathode.

2. An ion source as claimed in claim 1, wherein said perforated cathode has a transparency not exceeding much more than 50%.

3. An ion source as claimed in claim 1, wherein, for a control potential V of 1500 volts, said negative potential amounts to − 15 volts and said positive potential to + 20 volts.

4. An ion accelerator comprising an ion source of the kind claimed in claim 1.

* * * * *